US005566958A

United States Patent [19]

Sinelnikov et al.

[11] Patent Number: 5,566,958

[45] Date of Patent: Oct. 22, 1996

[54] IN-LINE SKATES WITH SLIDE MOTION WHEELS

[76] Inventors: Alexander S. Sinelnikov; Samuel D. Sinelnikov, both of 304 Larch Ct., Flemington, N.J. 08822

[21] Appl. No.: 507,088

[22] Filed: Jul. 26, 1995

[51] Int. Cl.[6] ..... A63C 17/06

[52] U.S. Cl. ..... 280/11.22; 280/809

[58] Field of Search ..... 280/11.19, 11.22, 280/11.23, 11.27, 842, 11.28, 293, 809, 811, 87.042

[56] References Cited

U.S. PATENT DOCUMENTS

| | | | |
|---|---|---|---|
| 301,676 | 7/1884 | Clark | 280/11.19 |
| D. 344,316 | 2/1994 | Gertler | D21/226 |
| 954,993 | 4/1910 | Peters | 280/11.19 |
| 1,981,211 | 11/1934 | Zareko | 280/11.26 |
| 2,190,316 | 2/1940 | Harris | 280/11.19 |
| 2,245,769 | 6/1941 | Flamm | 280/11.26 |
| 3,642,305 | 2/1972 | Pawsat | 280/293 |
| 4,700,964 | 10/1987 | Hess | 280/293 X |
| 4,887,824 | 12/1989 | Zatlin | 280/87.042 |
| 5,183,276 | 2/1993 | Pratt | 280/11.22 |
| 5,224,718 | 7/1993 | Gertler | 280/11.19 |
| 5,251,920 | 10/1993 | McHale | 280/11.19 |
| 5,295,701 | 3/1994 | Reiber et al. | 280/11.22 |

*Primary Examiner*—Anne Marie Boehler
*Assistant Examiner*—Michael Mar
*Attorney, Agent, or Firm*—Kenneth P. Glynn

[57] ABSTRACT

The present invention is directed to an in-line roller skate having a main frame with a front, a back, a top side and an underside, and having an attachment mechanism on the top side of the main frame for attachment of the in-line roller skate to the foot of the user and having an in-line skating wheel attachment frame on the underside of the main frame, with a plurality of in-line skating wheels thereon. The skate has a side motion wheel support and a plurality of side wheels rotatably connected to the support, arranged at approximately right angles to the skating wheels. The side wheels are arranged such that when the roller skate is placed on a flat surface upright with the skating wheels vertical, the skating wheels contact the flat surface and the side wheels do not, and when the roller skate is placed on the flat surface and tilted beyond a predetermined contact angle from vertical, the side wheels do contact the flat surface. In one preferred embodiment, the support and sidewheels are removably attached. In another preferred embodiment, the side wheels and support include height adjustment capabilities.

20 Claims, 3 Drawing Sheets

IN-LINE SKATES WITH SLIDE MOTION WHEELS

BACKGROUND OF THE INVENTION

1. Field of the Invention

The present invention relates to improved in-line roller skates adapted for side motion. These skates are particularly useful in skating activities where motion at about right angles is sometimes desired by in-line roller skate users, such as rollerblade hockey goalie lateral blocks and competition rail side slides.

2. Information Disclosure Statement

In-line roller skating (rollerblading or tandem skating, as it is also known) has become very popular because it provides users the opportunity to "skate" without the need for ice and cold. Such skating is done on in-line roller skates, which may be attachable to a boot or shoe, or more popularly, may have a permanent boot permanently formed on its main frame. Conventional in-line skates have single line wheels running from front to back and simulate the feel and motion of ice skating. The following patents illustrate the state-of-the-art as to unusual or modified wheel arrangements on skates:

U.S. Pat. No. Des. 344,316 issued to R. Gertler on Feb. 15, 1994 illustrates an ornamental design for a roller skate.

U.S. Pat. No. 301,676 issued to A. B. Clark on Jul. 8, 1884 describes a roller skate with the body of the skate and a plate secured thereto, of a double bracket having rollers mounted on independent shafts, and secured to the plate by means of a screw—bolt passing through an elongated slot in the bracket between the rollers, substantially as specified.

U.S. Pat. No. 954,993 issued to J. W. Peters on Apr. 12, 1910 describes a roller skate having in combination a supporting frame, of a plurality of pairs of rollers and a plurality of single rollers, the pairs of rollers and single rollers being disposed alternately in curvilinear arrangement, and the peripheries of the single rollers being disposed within those of the pairs of rollers, whereby a continuous bearing surface is presented from end to end of the skate.

U.S. Pat. No. 1,981,211 issued to J. A. Zareko on Nov. 20, 1934 shows in a skate, the combination of a foot-plate, a pair of spaced brackets rigidly fixed to each end of the bottom of the plate, the brackets extending in a series longitudinally of the plate, yokes having pivotal connection with the brackets, longitudinal of the plate, and their arms extending downwardly below the brackets, a socket member rigidly fixed to the plate within each pair of brackets, elastic means within the socket members, and between the plate and the yokes and on which the yokes bear, each elastic means extending in one piece over the pivot, and rollers mounted on the yokes.

U.S. Pat. No. 2,190,316 issued to F. A. Harris on Feb. 13, 1940 illustrates a roller skate with a chassis bar, two fork members slidably adjustably mounted on the bottom of said chassis bar, a wheel rotatably secured to each of the fork members, a supporting member slidably adjustably mounted on the bottom of the chassis bar and two wheels rotatably operatively secured to the supporting member, and a means for securing the chassis bar to the foot of the user.

U.S. Pat. No. 2,245,769 issued to A. L. Flamm on Jun. 17, 1941 describes a roller skate having a body including an upper surface, ground engaging rollers at the under side of the body, a guard secured to the body and depending at the lower side thereof, said guard comprising a hollow shell open at its upper side toward said body and having a roller receiving opening in its lower wall through which one of the roller projects, a housing, bearing means in the housing in which the roller is mounted, and means mounting the housing in the guard adjacent the opening whereby the front and side walls of the guard enclose and conceal the housing, bearing means and a larger portion of the roller.

U.S. Pat. No. 5,183,276 issued to K. W. Pratt on Feb. 2, 1993 describes a balance training apparatus for a roller transportation device which has a series of in-line wheels positioned beneath the user's foot. The training apparatus has a U-shaped wheel well attached to the tandem roller skate for positioning a training wheel adjacent the roller wheels for rotation about an axis parallel with the axis of the roller wheel rotation and along a parallel, nonintersecting line of travel to the roller wheels when the roller wheels engage a travel surface at an acute angle.

U.S. Pat. No. 5,224,718 issued to R. Gertler on Jul. 6, 1993 describes a foot transport device for fastening to a foot, in particular, a roller skate. The device has a sole portion to which is affixed a plurality of wheels arranged successively in tandem along the longitudinal length of the sole portion. A removable stabilizer is arranged on either side of the sole portion to allow the unskilled to learn to use the device. The stabilizer protrudes laterally outwardly on wheels. The stabilizer may comprise wheels or an outrigger blade.

U.S. Pat. No. 5,251,920 issued to P. McHale on Oct. 12, 1993 relating to roller skates which have a shoe or boot supported by a central support beam. The boot has an inside and outside corresponding to the inside and the outside of a user's foot to which it is designed to be removably attached. Each skate also has a first and second group of wheels in longitudinal alignment with the roller skate and in rotatable alignment with each other. The boot and groups of wheels are connected to a support structure. The first group of wheels is rotatably attached to the support structure and disposed to the outside thereof. The second group of wheels is rotatably attached to the support structure and disposed to the inside thereof. A first span between the most distant of the wheels of the first group of wheels is less than a second span between the most distant of the wheels of the second group of wheels. There are also brake means for slowing and stopping the roller skate when a user desires.

U.S. Pat. No. 5,295,701 issued to F. M. Reiber et al. on Mar. 22, 1994 relates to a roller skate assembly which includes a sole portion which has longitudinally aligned front and rear rollers mounted thereon and a center roller which is mounted on the sole portion between the front and rear rollers. The center roller is alternatively positionable in a longitudinally aligned position relative to the front and rear rollers or a transversely offset position relative thereto.

Notwithstanding the prior art, the present invention is neither taught nor rendered obvious thereby.

SUMMARY OF THE INVENTION

The present invention is directed to an in-line roller skate having a main frame with a front, a back, a top side and an underside, and having an attachment mechanism on the top side of the main frame for attachment of the in-line roller skate to the foot of the user and having an in-line skating wheel attachment frame on the underside of the main frame, with a plurality of in-line skating wheels thereon. The skate has a side motion wheel support and a plurality of side wheels rotatably connected to the support, arranged at approximately right angles to the skating wheels. The side wheels are arranged such that when the roller skate is placed on a flat surface upright with the skating wheels vertical, the skating wheels contact the flat surface and the side wheels do not, and when the roller skate is placed on the flat surface and tilted beyond a predetermined contact angle from vertical, the side wheels do contact the flat surface. In one preferred embodiment, the support and sidewheels are removably attached. In another preferred embodiment, the side wheels and support include height adjustment capabilities.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 2:
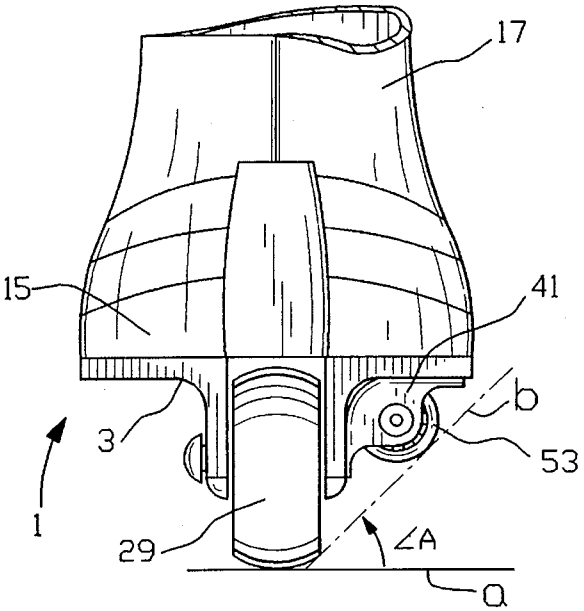
FIG. 2 shows a rear view thereof.

As mentioned above, the present invention is directed to an in-line roller skate which is particularly useful for performing side maneuvers. While in-line roller skating is exciting to a user and simulates ice skating without the need for the cold temperature and the ice surface, side maneuvers on in-line roller skates cannot be accomplished in a fashion similar to ice skating. Thus, the present invention has as a primary object the purpose of providing users with sidewheel which are located on the bottoms of the roller skates in such a fashion that they are generally not functional (not in contact with the surface) when normal skating is being performed. More specifically, the present invention roller skates have sidewheels aligned at right angles to the skating wheels. Thus, their axis of rotation is at right angles to the access of rotation of the skating wheels. Typically, these sidewheels are of smaller diameter, although this is not essential to the functioning of the present invention roller skates. However, what is essential is that the sidewheels be located "off the ground" during normal skating functions. Thus, the sidewheels are located so that they have bottom wheel contact areas at a height greater than the bottom wheel contact areas of the main, in-line, skating wheels.

The present invention in-line roller skates have a main frame which may be conventional to existing rollerblade skates in that they will have a back, a top, an underside and will be adapted so as to have some form of attachment mechanism or attachment means on the top side so that the roller skate may be attached to the foot of the user. This attachment means may come in the form of foot and heel components for strapping the rollerblade onto a shoe or boot of a user, or, alternatively, may include a boot itself as part of the roller skate structure. The main frame has on its underside a skating wheel attachment frame. By "skating wheel attachment frame" is meant brackets or other angled mechanisms which extended downwardly from the underside or bottom of the roller skate main frame and provide orifices for the axles for the in-line skating wheels. Thus, the in-line skating wheel attachment frame may be integrally formed with the main frame or may be separately attached thereto. The present invention roller skate further includes a plurality of skating wheels attached to the skating attachment frame and these are typically three or four wheels, but could be as few as two and could be more than four without exceeding the scope of the present invention. The critical improvement of the present invention in-line roller skate over existing in-line roller skates involves the use of a side motion wheel support means or mechanism attached to at least one of the main frame and the skating wheel attachment frame and preferably attached to both. This side motion wheel support will have a plurality of sidewheels rotatably connected to it and arranged at approximately right angles to the skating wheels. These sidewheels are arranged such that when the roller skate is placed on a flat surface upright with the skating wheels vertical or substantially vertical or even tilted to some degree, the skating wheels contact a flat surface but the sidewheels do not, and such that when the roller skate is place on the flat surface and tilted beyond a predetermined contact angle from vertical, the sidewheels do contact the flat surface. This predetermined contact angle will be at least 20° from the horizon and preferably 30° to 55° as measured from the horizon or horizontal line extending from the bottom of the main frame skating wheels. For example, most preferred would be angles in the range of 35° to 50°. This enables a skater to use the present invention roller skates in a conventional fashion but when desiring to have side motion, by angling the leg and/or ankle so that the desired predetermined contact angle or greater is achieved, sidewheels take over the contacting and allow the foot to slide. Such movements would be particularly advantageous for goalies in street hockey games so as to permit them to achieve rapid substantial lateral movements for blocking goals. Additionally, extreme roller skating competition requires sliding moves at right angles to the skates and these could be enhanced or better controlled by the use of sidewheels. Finally, the sidewheels may simply be used for achieving some interesting maneuvers for the pleasure of the user or for even creating unusual choreographic or other skating presentations. The sidewheels are attached to the insole aspects of the rollerblades so that the user will be able to benefit from normal leg angle changes, i.e. moving the foot or ankle or leg from the hip outwardly away from the other leg will cause the rollerblade to pitch inwardly and will result, when desired, with direct contact of the sidewheels to a skating surface.

The present invention in-line roller skate may have the side motion wheel support means or bracket attached directly to the main frame or to the skating wheel attachment frame or to both, as mentioned. In some embodiments it will be permanently attached and in others it will be removably attached. Thus, a goalie could remove the sidewheels and side motion wheel support means to have conventional in-line roller skates when not acting in the position of a goalie. In some preferred embodiments, the height of the sidewheels may be adjustable. This could be achieve by having a single adjustment capability for the side motion wheel support means such as by placing collars or washers or other displacement units on fasteners or screws which connect the side motion wheel support means to the skate. In other words, these spacer, collars, washers or other items would be placed between the main frame and the side motion wheel support means to achieve various heights. Alternatively, the skating wheel attachment frame could have screw holes or other attachment mechanisms at different heights so that the side motion wheel support means could be adjustably attached to the skate. Finally, the sidewheels themselves could have multiple positions or elongated slots with locking mechanisms which would enable a user to adjust the heights of the individual wheels and these could have predetermined multiple settings as more fully described below in conjunction with the drawings.

Figure 1:
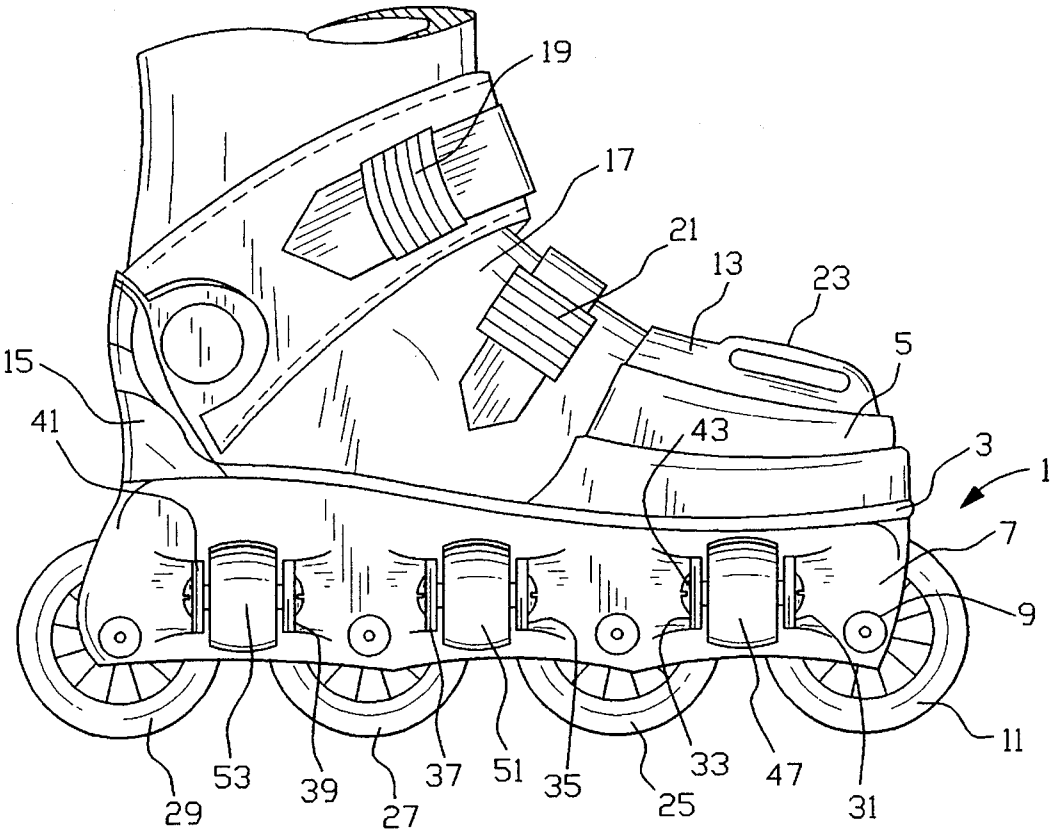
FIG. 1 shows a right side view of a left foot version of a present invention in-line roller skate device with permanently attached sidewheels.

Referring now to the drawings FIGS. 1 and 2 show a right side view of a left in-line roller skate of the present invention and a rear view thereof, respectively. There is shown present invention in-line roller skate 1 which includes main frame 3 and skating wheel attachment frame 7. This includes orifices with axles such as axle 9 attached to in-line skating wheel 11. Behind in-line skating wheel 11 and a single alignment are additional skating wheels 25, 27 and 29. In this embodiment, on the top side of main frame 3 is a full boot 5 that includes a toe section 13 and a heel section 15, as shown. Toe section 13 includes an optional dart attachment means 23, in this case, an open loop cast in the plastic or other construction material. There is an ankle section 17 with attachment straps 19 and 21 and these may be of conventional design in nature.

Present invention in-line roller skate 1 includes side motion wheel support means which, in this case, constitute a plurality of brackets, but could be a single structure in the alternative. Thus, brackets forming pairs are shown as brackets 31 and 33, 35 and 37, and 39 and 41. They support sidewheels 47, 51 and 53, as shown. Typical axle attachments are utilized such as axle attachment 43, in this case, utilized to rotatably secure sidewheel 47. Other sidewheels 51 and 53 are similarly attached.

As shown in FIG. 2, the rear view displays the relative size and position of skating wheel 29 and sidewheel 53. The base shows an angle "A" which is measured as the angle between line "a" which represents the horizon and the surface upon which skating wheel 29 rests and line "b" which is the connecting line between the skating wheel 29 and the sidewheel 53. Angle "A" is the predetermined contact angle mentioned above and, as can be seen from FIG. 2, when present invention roller skate 1 is tilted to the right downwardly, at the angle "A" when skating wheel 29 achieves a tilted angle equal to or greater than angle "A" it will be seen that sidewheel 53 will contact the bottom surface "a". Beyond "A" sidewheel 53 will contact surface "a" and skating wheel 29 will be lifted upwardly so that sidewheel 53 will take over completely and afford the skater sidewheel movement. Then, tilting back to an angle in the opposite direction wherein both sidewheel 53 and skating wheel 29 are both in contact or skating wheel 29 is alone in contact, skating wheel 29 will be at right angles to the direction of movement and will act as a breaking mechanism.

Figure 3:
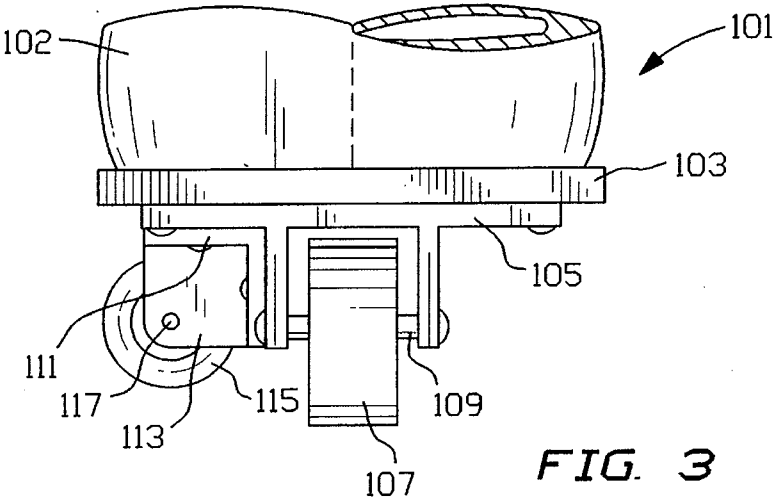
FIG. 3 shows a partial rear view of a right foot present invention in-line roller skate wherein the main frame, the skating wheel support member and the sidewheel support member are separate elements permanently attached to one another.

Referring now to FIG. 3, there is shown an alternative embodiment present invention in-line roller skate 101. This has a boot section 102, a main frame 103 and, in this case, a skating wheel attachment frame 105 which is a double bracketed frame attached directly by rivet to main frame 103 and includes an axle 109 and a skating Wheel 107 which is typical of a plurality of such wheels aligned directly behind one another. Further, side motion wheel support bracket 111 is riveted to the skating wheel attachment frame 105 and includes a plate 113 and a similar plate behind it not shown, which supports axle 117 and sidewheel 115. This would be a right foot skate with an insole positioned sidewheel 115, relative to skating wheel 107. There would be a plurality of sidewheels such as sidewheel 115 arranged in a group of two, three, four or more, as desired.

Figure 4:
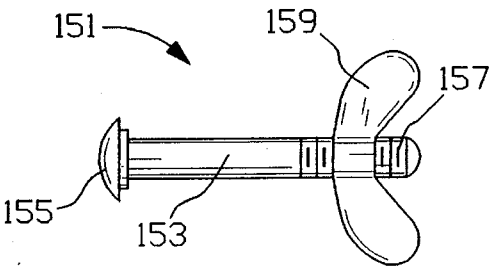
FIG. 4 shows a front view of a locking mechanism for adjustable sidewheels used in some preferred embodiments of the present invention and FIGS. 5 and 6 show rear and left side views of a sidewheel support member with adjustable heights; and, FIG. 7shows a right side view of a left foot present invention in-line skate with a removable sidewheel support member which is removably attached to both the main frame and the combined skating wheel support bracket.
Figure 5:
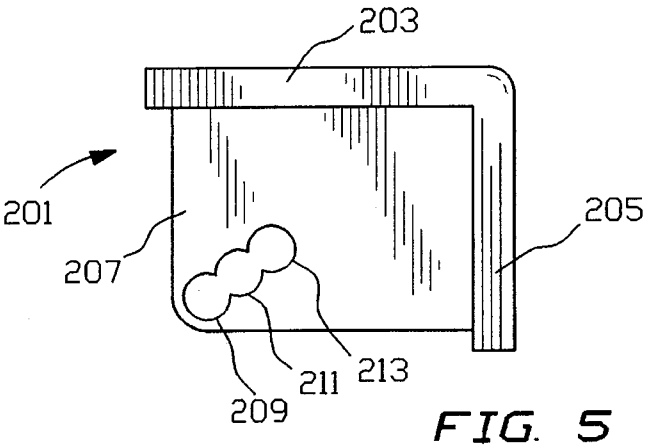
Figure 6:
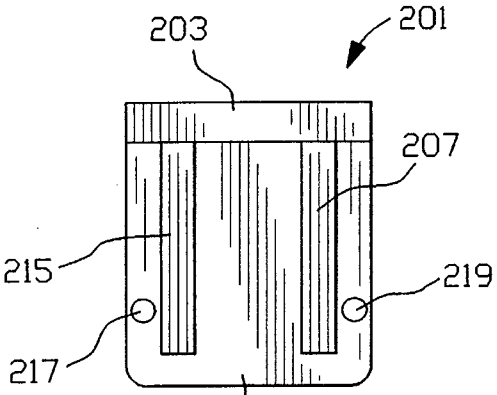

FIG. 4 shows a front view of a fastening mechanism 151 which may be used for adjustable sidewheels in a present invention preferred embodiment. This constitutes a bolt 153 with a head 155 and a threaded area 157, coupled with a wing nut 159. Referring to FIGS. 5 and 6, there is shown a side motion wheel support bracket which would be adapted to receive fastening mechanism 151 for adjustable height sidewheels. Thus, sidewheel motion support bracket 201 is shown in FIGS. 5 and 6 in its rear and left side view and includes right angled plate sections 203 and 205 along with right angled section 207 and 215. Attachment means are orifices for screws or rivets shown as orifices 217 and 219. Located on right angled section 207 are a plurality of overlapping orifices 209, 211 and 213 which afford a sidewheel to be locked into any one of those three positions with the use of fastening mechanism 151 shown in FIG. 4. This is, of course, only one allustrotive method of making adjustable height sidewheels and other methods are discussed above and additional methods may now be apparent to the artisan.

Figure 7:
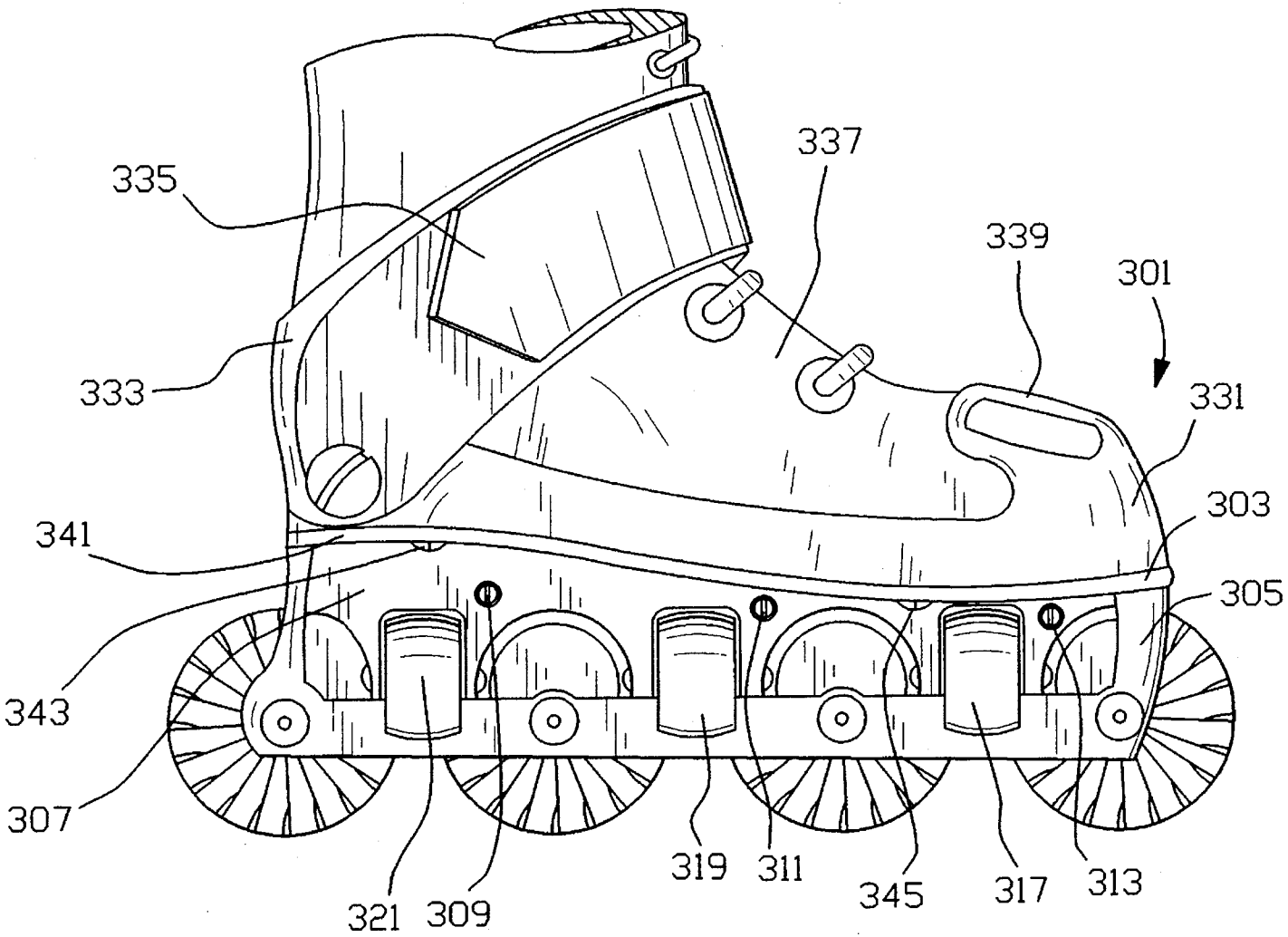

FIG. 7 shows a right side view of a present invention left foot in-line roller skate 301. In this embodiment, the skate 301 has a main frame 303 and a skating wheels support frame 305. It includes the skating wheels as shown and includes a toe portion 331 and a heel portion 333 with fastening strap 335 adapted to receive a shoe or boot 337 which would be separate and apart from skate 301. The important feature which is a variation on that described above is shown as side motion wheel support bracket 307. This is screwed to both main frame 303 and skating wheel support frame 305 such as by screws 309, 311 and 313 for the skating wheel support frame attachment and screws 343 and 345 for attachment to the main frame 303. Thus, sidewheels 317, 319 and 321 are attached with a single bracket or support means. Further, as mentioned above, spacers could be used with the top screws or multiple holes with different heights could be used for the side screws with side motion wheel support bracket 307 to achieve adjustable height arrangements, as may be desired and, most significantly, afford this embodiment to be removable so that the sidewheels and support means can be taken off the skate and rendered convertible to a conventual skate. variations of the present invention are possible in light of the above teachings. For example, in-line skates may be left/right interchangeable and such skates could include attachment means on both undersides (left and right) of the main frame so that a side motion wheel support may be attached, interchangeably, to either side. It is therefore understood that within the scope of the appended claims, the invention may be practiced otherwise than as specifically described herein.

What is claimed is:

1. In an in-line roller skate having a main frame with a front, a back, a top side and an underside, and having attachment means on the top side of said main frame for attachment of said in-line roller skate to the foot of a user and having an in-line skating wheel attachment frame on the underside of said main frame, and having a plurality of skating wheels in-line running from the front to the back along a longitudinal axis of the roller skate and rotatably attached to said wheel attachment frame for rotation about axes extending transverse to said longitudinal axis, the improvement which comprises:

having connected to at least one of said main frame and said skating wheel attachment frame, side motion wheel support means and a plurality of side wheels rotatably connected to said support means for rotation about a fixed axis extending parallel to said longitudinal axis and arranged at approximately right angles to said skating wheels, said side wheels being arranged such that when said roller skate is placed on a flat surface upright with said skating wheels vertical, said skating wheels contact said flat surface and said side wheels do not, and such that when said roller skate is placed on said flat surface and tilted beyond a predetermined contact angle from vertical, said side wheels do contact said flat surface.

2. The in-line roller skate of claim 1 wherein said main frame has a general top view shape of a human foot with an insole and said side motion wheel support means and said side wheels are mounted on said insole relative to said skating wheels.

3. The in-line roller skate of claim 1 wherein said predetermined contact angle is at least 20° as measured from horizontal.

4. The in-line roller skate of claim 1 wherein said predetermined contact angle is between about 25° and about 55° as measured from horizontal.

5. The in-line roller skate of claim 1 wherein said motion wheel support means is permanently attached to at least one of said main frame and said skating wheel attachment means.

6. The in-line roller skate of claim 5 wherein said side motion wheel support means is permanently attached to both of said main frame and said skating wheel attachment means.

7. The in-line roller skate of claim 1 wherein said plurality of side wheels have a smaller diameter than the diameter of said skating wheels.

8. The in-line roller skate of claim 1 wherein said main frame includes a toe encasement member attached to its top and said toe encasement member includes hockey angle guard attachment means.

9. The in-line roller skate of claim 1 wherein said main frame includes height adjustment means for adjusting height of said side wheels.

10. The in-line roller skate of claim 9 wherein said height adjustment means includes an elongated slot and a locking fastener for each of said side wheels.

11. In an in-line roller skate having a main frame with a front, a back, a top side and an underside, and having attachment means on the top side of said main frame for attachment of said in-line roller skate to the foot of a user and having an in-line skating wheel attachment frame on the underside of said main frame, and having a plurality of skating wheels in-line running from the front to the back along a longitudinal axis of the roller skate and rotatably attached to said wheel attachment frame for rotation about axes extending transverse to said longitudinal axis, the improvement which comprises:

having connected to at least one of said main frame and said skating wheel attachment frame, side motion wheel support means and a plurality of side wheels rotatably connected to said support means for rotation about a fixed axis extending parallel to said longitudinal axis and arranged at approximately right angles to said skating wheels, said side wheels being arranged such that when said roller skate is placed on a flat surface upright with said skating wheels vertical, said skating wheels contact said flat surface and said side wheels do not, and such that when said roller skate is placed on said flat surface and tilted beyond a predetermined contact angle from vertical, said side wheels do contact said flat surface, further wherein said side motion wheel support means is removably connected to at least one of said main frame and said skating wheel attachment frame.

12. The in-line roller skate of claim 11 wherein said main frame has a general top view shape of a human foot with an insole and said side motion wheel support means and said side wheels are mounted on said insole relative to said skating wheels.

13. The in-line roller skate of claim 11 wherein said predetermined contact angle is at least 20° as measured from horizontal.

14. The in-line roller skate of claim 11 wherein said predetermined contact angle is between about 25° and about 55° as measured from horizontal.

15. The in-line roller skate of claim 11 wherein said motion wheel support means is removably attached to at least one of said main frame and said skating wheel attachment means.

16. The in-line roller skate of claim 5 wherein said side motion wheel support means is removably attached to both of said main frame and said skating wheel attachment means.

17. The in-line roller skate of claim 11 wherein said plurality of side wheels have a smaller diameter than the diameter of said skating wheels.

18. The in-line roller skate of claim 11 wherein said main frame includes a toe encasement member attached to its top and said toe encasement member includes hockey angle guard attachment means.

19. The in-line roller skate of claim 11 wherein said main frame includes height adjustment means for adjusting height of said side wheels.

20. The in-line roller skate of claim 19 wherein said height adjustment means includes an elongated slot and a locking fastener for each of said side wheels.

* * * * *